US011953021B2

(12) United States Patent
Yoshino

(10) Patent No.: US 11,953,021 B2
(45) **Date of Patent: *Apr. 9, 2024**

(54) AIR BLOWER

(71) Applicant: Nidec Corporation, Kyoto (JP)

(72) Inventor: Shingo Yoshino, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/846,137

(22) Filed: Jun. 22, 2022

(65) Prior Publication Data

US 2022/0316492 A1 Oct. 6, 2022

Related U.S. Application Data

(63) Continuation of application No. 16/785,684, filed on Feb. 10, 2020, now Pat. No. 11,378,092.

(30) Foreign Application Priority Data

Feb. 28, 2019 (JP) ..... 2019-036813

(51) Int. Cl.

| | |
|---|---|
| ***F04D 29/32*** | (2006.01) |
| ***F04D 25/06*** | (2006.01) |
| *F04D 29/38* | (2006.01) |
| *F04D 29/66* | (2006.01) |

(52) U.S. Cl.

CPC ..... *F04D 29/325* (2013.01); *F04D 25/0613* (2013.01); *F04D 29/38* (2013.01); *F04D 29/666* (2013.01)

(58) Field of Classification Search

CPC ..... F04D 1/00; F04D 17/00; F04D 25/0613; F04D 23/003; F04D 29/62; F04D 25/08; F04D 17/16; F04D 29/325; F04D 29/38; F04D 29/4226; F04D 29/441; F04D 29/601; F04D 29/626; F04D 29/666

See application file for complete search history.

(56) References Cited

U.S. PATENT DOCUMENTS

| | | | | |
|---|---|---|---|---|
| 7,063,504 | B2 * | 6/2006 | Huang | F04D 29/526 415/165 |
| 7,351,032 | B2 * | 4/2008 | Horng | F04D 29/547 415/223 |
| 7,737,589 | B2 * | 6/2010 | Sekiguchi | H02K 1/182 310/90 |
| 8,365,811 | B2 * | 2/2013 | Yamashita | H01L 23/467 165/80.3 |

(Continued)

OTHER PUBLICATIONS

"Air Blower", U.S. Appl. No. 16/785,684, filed Feb. 10, 2020.

*Primary Examiner* — Jesse S Bogue

(74) *Attorney, Agent, or Firm* — Keating & Bennett, LLP

(57) ABSTRACT

An air blower includes an impeller rotatable about a central axis extending vertically, a motor to rotate the impeller, and a holder to hold the motor. The air blower is a centrifugal air blower which generates a radial airflow perpendicular to the central axis. The holder includes a base supporting the motor, attachments on a radial directional-outer side of the impeller, arms connecting the base and each of the attachments, and a wall surface on a side of the impeller, between the base and each attachment, and opposing a radial-directional inner side. An axial lower end of the impeller is located below an axial upper end of the wall surface.

10 Claims, 14 Drawing Sheets

(56) References Cited

U.S. PATENT DOCUMENTS

| | | | | |
|---|---|---|---|---|
| 9,127,687 | B2 * | 9/2015 | Fujimoto | F04D 17/16 |
| 10,954,956 | B2 * | 3/2021 | Chang | F04D 25/062 |
| 11,378,092 | B2 * | 7/2022 | Yoshino | F04D 29/441 |
| 2003/0202879 | A1 * | 10/2003 | Huang | F04D 29/526<br>415/220 |
| 2003/0219339 | A1 * | 11/2003 | Huang | F04D 29/547<br>415/220 |
| 2009/0142190 | A1 * | 6/2009 | Horng | F04D 25/0613<br>415/214.1 |
| 2012/0134795 | A1 * | 5/2012 | Fukuda | F04D 29/4226<br>415/206 |
| 2012/0201670 | A1 * | 8/2012 | Takeshita | F04D 29/522<br>415/212.1 |
| 2013/0084173 | A1 * | 4/2013 | Fukuda | F04D 29/30<br>415/203 |

* cited by examiner

AIR BLOWER

CROSS REFERENCE TO RELATED APPLICATION

The present application is a Continuation of U.S. application Ser. No. 16/785,684, filed on Feb. 10, 2020, which application claims priority under 35 U.S.C. § 119 to Japanese Application No. 2019-036813, filed on Feb. 28, 2019, the entire contents of which are hereby incorporated herein by reference.

FIELD OF THE DISCLOSURE

The present disclosure relates to an air blower.

BACKGROUND

For example, it is known that a conventional centrifugal-type fan is provided with an impeller on which a plurality of blades, a casing accommodating the impeller, and a motor. In addition, the impeller is driven and rotated by the motor. A shape of the casing of the centrifugal fan is square when viewed in a plan view. All four side faces of the casing of the centrifugal fan have openings formed therein. That is, the side faces of the casing have a configuration including only columns.

In the centrifugal fan, since the side wall of the casing is open, airflow is not easily disturbed by the side wall. Accordingly, noise due to turbulence of the airflow in the side wall at the time of blowing air is reduced.

However, in the conventional air blower, a cylindrical column is disposed in the airflow, and turbulence is generated around the column and thereby the airflow may become easily turbulent such that noise caused by turbulence of the airflow is easily increased.

SUMMARY

An air blower according to an example embodiment of the present disclosure includes an impeller rotatable about a central axis extending vertically, a motor to rotate the impeller, and a holder to hold the motor. The air blower is a centrifugal air blower which generates a radial airflow perpendicular to the central axis. The holder includes a base on which the motor is provided, a plurality of attachments on a radial directional-outer side of the impeller, a plurality of arms connecting the base and each of the attachments, and a wall surface located at a side where the impeller is provided, between the base and each attachment, and opposing a radial-directional inner side. An axial lower end of the impeller is located below an axial upper end of the wall surface.

The above and other elements, features, steps, characteristics and advantages of the present disclosure will become more apparent from the following detailed description of the example embodiments with reference to the attached drawings.

DETAILED DESCRIPTION

Hereinafter, example embodiments of the present disclosure are described in detail with reference to the drawings. In addition, in an air blower A in this specification, a direction parallel to a central axis Cx of the air blower A is referred to as an "axial direction", a direction perpendicular to the central axis Cx of the air blower A is referred to as a "radial direction", and a direction along an arc centered on the central axis Cx of the air blower A is referred to as a "circumferential direction". Similarly, with respect to an impeller 30, directions coinciding with the axial direction, the radial direction, and the circumferential direction of the air blower A when the impeller 30 is assembled in the air blower A are simply referred to as an "axial direction", a "radial direction", and a "circumferential direction", respectively. Further, a face directed towards the upper side in the axial direction is referred to as an "upper face", and a face directed towards the lower face in the axial direction is referred to as a "lower face".

Figure 1:
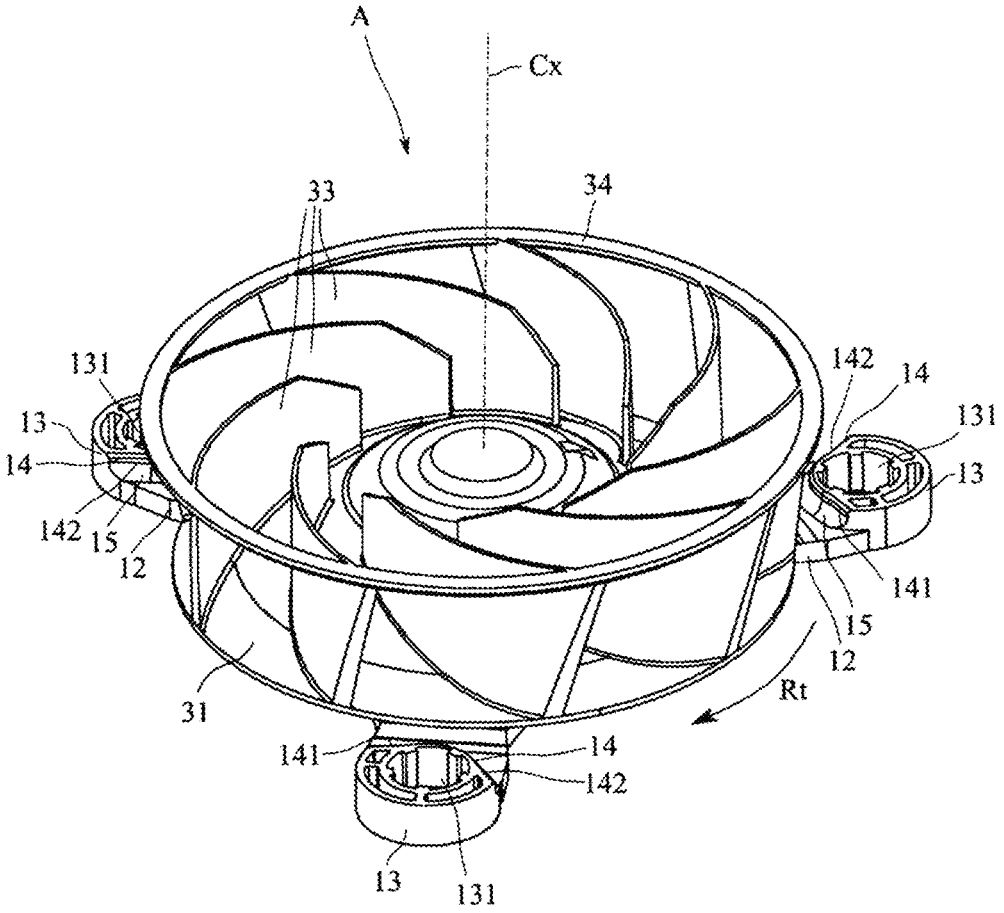
FIG. 1 is a perspective view of an air blower according to an example embodiment of the present disclosure.
Figure 2:
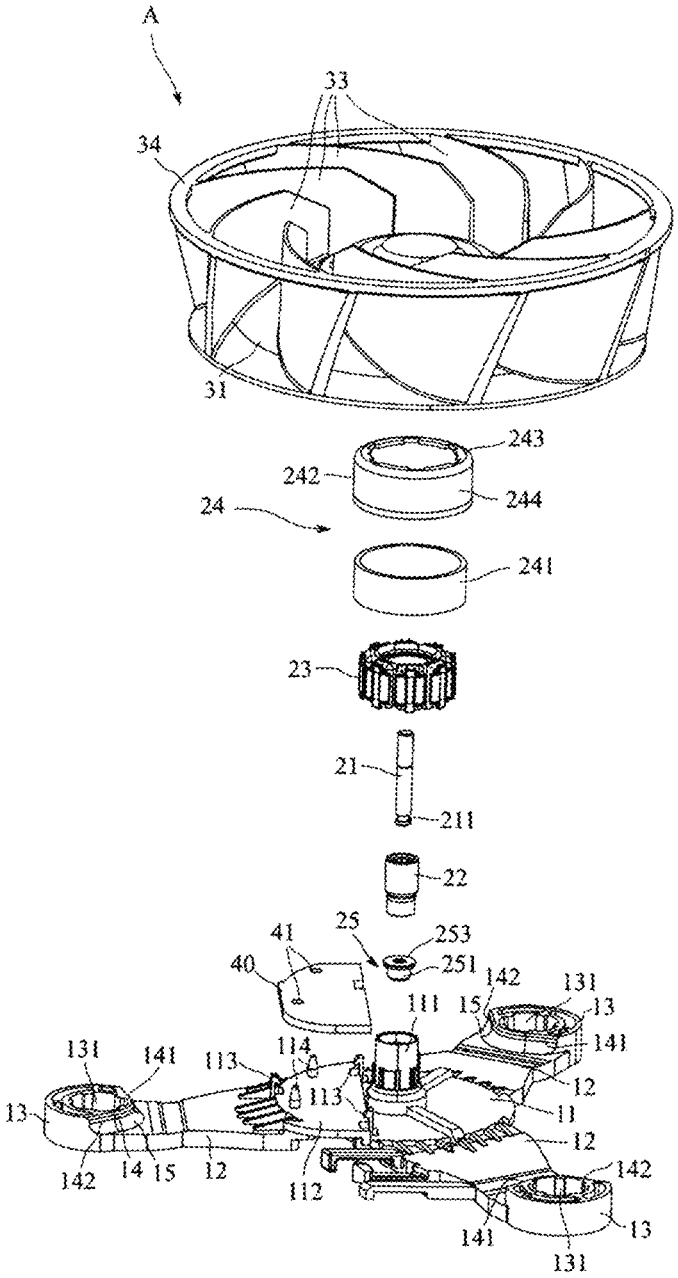
FIG. 2 is an exploded perspective view of the air blower shown in FIG. 1.
Figure 3:
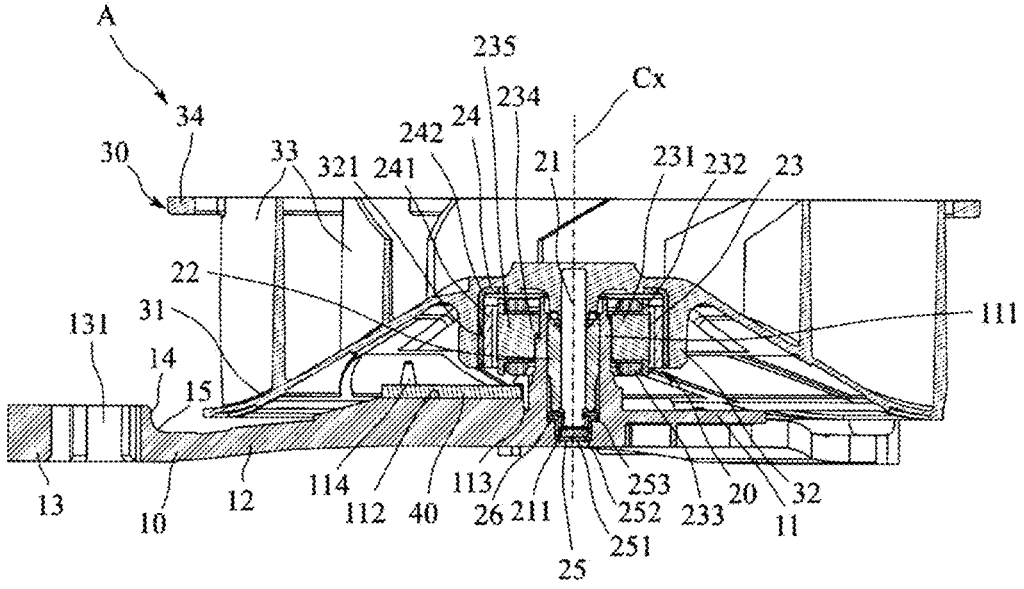
FIG. 3 is a longitudinal sectional view of the air blower shown in FIG. 1.

Below, an air blower of an example embodiment of the present disclosure is described. FIG. 1 is a perspective view of an air blower A. FIG. 2 is an exploded perspective view of the air blower A shown in FIG. 1. FIG. 3 is a longitudinal cross-sectional view of the air blower A shown in FIG. 1. The blowing device A includes a holder 10, a motor 20, the impeller 30, and a circuit board 40.

The impeller 30 is rotated around the central axis Cx extending in a vertical direction. The motor 20 is disposed in the lower direction of the impeller 30 and rotates the impeller 30. The holder 10 is attached to an object while holding the motor 20 to which the impeller 30 is attached. That is, the impeller 30 is rotated around the central axis extending vertically. The motor 20 rotates the impeller 30. The holder 10 holds the motor 20.

Figure 4:
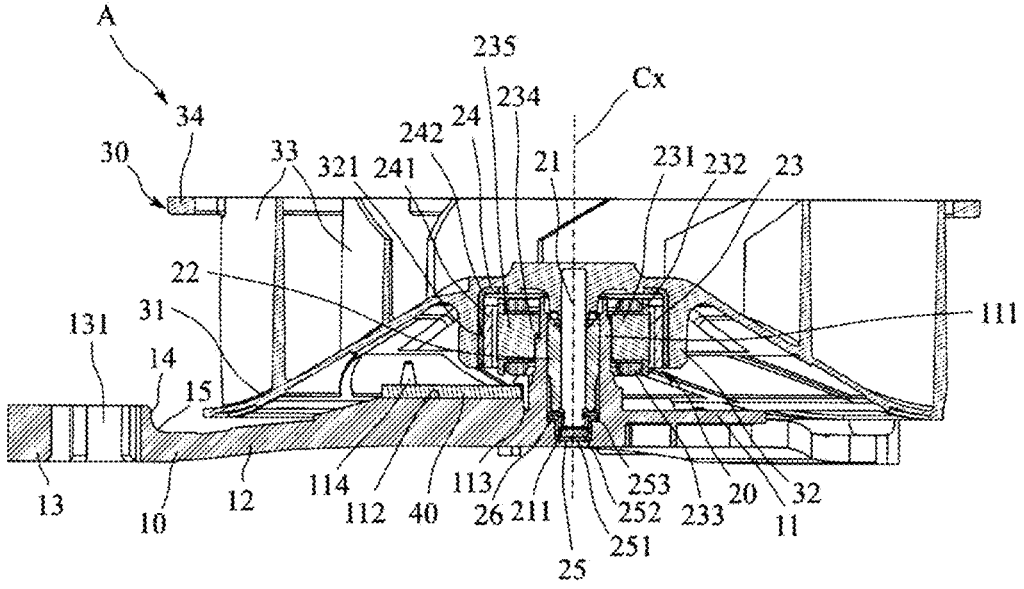
FIG. 4 is a plan view of a holder.

First, a configuration of the holder 10 is described with reference to the drawings. FIG. 4 is a plan view of the holder 10. As shown in FIG. 4, the holder 10 includes a base 11, three arms 12, and a plurality of attachments 13. The holder 10 is, for example, a molded body made of resin. In addition, the holder 10 is not limited to a molded body made of resin.

As shown in FIGS. 2 to 4, the base 11 is disposed at a radial-directional center of the holder when the holder 10 is viewed in an axial direction. The base 11 has a circular plate or substantially circular plate shape. The base 11 includes a housing 111, a board attachment 112, three board holding parts 113, and two bosses 114. The housing 111 has a cylindrical or substantially cylindrical shape extending upwardly in the axial direction from the radial-directional center of the base 11. A bearing 22 provided in the motor 20 is disposed in the housing 111 in the radial direction. The bearing 22 is fixed to an inner circumferential surface of the housing 111. In addition, a stator 23 of the motor 20 is fixed to an outer circumferential surface of the housing 111. That is, the holder 10 is provided with the base 11 on which the motor 20 is provided.

The board attachment 112 is provided on an upper face of the base 11. The two bosses 114 extend upwardly from an upper face of the board attachment 112. The boss 114 has a cylindrical or substantially cylindrical shape including a tapered part whose upper part becomes thin upwardly. The boss 114 is inserted into a board penetrating hole 41 provided in the circuit board 40. Due to this configuration, when the circuit board 40 is attached to the base 11, movements of the circuit board 40 in the circumferential direction and the radial direction are restricted. In addition, in order to limit the movements of the circuit board 40 in the circumferential direction and the radial direction, it is preferable that at least two or more bosses 114 and at least two or more board penetrating holes 41 are provided.

The circuit board 40 is held in the board holding part 113. The board holding part 113 protrudes upwardly from the board attachment 112, and is elastically deformable. Further, the board holding part 113 has a claw provided at an upper end thereof. In addition, the claw is brought into contact with an outer edge of the circuit board 40 and is moved downwardly such that the claw is pressed and thereby the board holding part 113 is elastically deformed. By further pressing the circuit board 40, the claw comes into contact with an upper face of the circuit board 40 such that upward retaining of the circuit board 40 occurs.

As shown in FIG. 4, the arm 12 extends outwardly in the radial direction from a radial outer edge of the base 11. A radial outer edge of the arm 12 is located outwardly farther than a radial outer edge of the impeller 30. Three arms 12 are disposed at an equal interval in the circumferential direction. As shown in FIG. 3, the radial outer edge of the arm 12 is located downwardly farther than the base 11. In addition, the attachment 13 is connected to a radial outer end of each arm 12. That is, the holder 10 is provided with the plurality of attachments 13 disposed in the radial direction outwardly farther than the impeller 30, and the arms 12 connecting the base 11 and the attachment 13.

As shown in FIGS. 1 to 3, the attachment 13 has a cylindrical or substantially cylindrical shape extending upwardly from an upper face of the arm 12 and has a through hole 131 penetrating the attachment 13 in the axial direction. By passing a screw through the through hole 131 and screwing the screw, the attachment 13 is fixed to a location to be installed. At this time, in order to place an upper end of the screw, that is, a head of the screw downwardly farther than an upper face of the attachment 13, a recess (not shown) in which the head of the screw is accommodated may be provided. Further, as shown in FIG. 4, the attachment 13 has a shape in which a part of a cylindrical or substantially cylindrical outer circumferential part is notched. In addition, a notched cylindrical end face is a wall face 14. That is, the wall face 14 is provided on an outer side face of the attachment 13.

In the holder 10, the wall face 14 is provided at a part of the outer side face of each attachment 13, which protrudes upward from the upper face of the arm 12. In addition, all of the three wall face 14 about a radial-directional inner side. The wall face 14 is provided with a first face 141 and a second face 142. In addition, each of the first faces 141 is disposed in rotationally symmetric manner (in this example embodiment of the present disclosure, three times symmetry), and each of the second faces 142 are disposed in rotationally symmetric manner (in this example embodiment of the present disclosure, three times symmetry).

That is, at least one of the wall faces 14 is further provided with the second face 142 connected to the rotational-directional rear of the first face 141. In addition, at least a part of the wall faces 14 is provided on the outer side face of the attachment 13. By forming the wall face 14 on the outer side face of the attachment 13 in this manner, it is possible to simplify the shape of the holder 10.

On the wall face 14, the second face 142 and the first face 141 are disposed side by side from the rear to the front with respect to a rotational-direction Rt of the impeller 30 (see FIG. 1). That is, between the base 11 and the attachment 13, the holder 10 is provided on the side where the impeller 30 is disposed, and includes the wall face 14 abutting the radial-directional inner side.

Although details will be described later, airflow Afw generated by rotation of the impeller 30 flows outwardly in the radial direction and in the rotational direction Rt of the impeller 30 (see FIG. 5 described later). A part of this airflow Afw flows along the first face 141 as front airflow Af1 from a connection part between the first face 141 and the second face 142. In addition, the remainder of the airflow Afw flows as rear airflow Af2 along the second face 142.

The first face 141 extends outwardly in the radial direction radially outward while being directed towards the front of the rotational direction Rt of the impeller 30. The first face 141 faces an axial lower end of the impeller 30 in the radial direction. The first face 141 has a curved face or substantially curved face shape. For this reason, it is difficult to release the front airflow Af1 flowing along the first face 141. In addition, as long as the first face is difficult to release the front airflow Af1, the first face 141 may have a planar or substantially planar shape. That is, the first face 141 has a planar or substantially planar shape. By making the first face 141 have a planar or substantially planar shape, the configuration of the holder 10 becomes simplified and manufacture thereof gets easier.

In addition, a face 140 extending the rear side of the rotational direction Rt of the impeller 30 on the first face 141 in the circumferential direction is located outwardly in the radial direction (See FIG. 5 described later). The details of the flow of the front airflow Af1 will be described later.

The second face 142 extends outwardly in the radial direction while being directed towards the rear of the rotational direction Rt of the impeller 30. The second face 142 faces the axial lower end of the impeller 30 in the radial direction. The second face 142 has a curved face or substantially curved face shape. For this reason, it is difficult to release the rear airflow Af2 flowing along the second face 142. In addition, as long as the second face 142 is difficult to release the rear airflow Af2, the second face 142 may have a planar or substantially planar shape. The details of the flow of the rear airflow Af2 will be described later.

The front of the rotational direction Rt of the second face 142 is connected to the rear of the rotational direction Rt of the first face 141. The first face 141 and the second face 142 are smoothly continuous. Due to this configuration, when the airflow Afw is branched into the front airflow Af1 and the rear airflow Af2 and flows, the airflow Afw is less likely to be turbulent. In addition, the expression "smoothly continuous" indicates to be continuous while maintaining a possibility to be differentiated, in other words, to be continuous while a sharpened part is not generated. Further, the connecting part of the first face 141 and the second face 142 is not limited to the above-mentioned configuration, and a shape making it difficult for the flow to be turbulent when the airflow Afw is branched into the front airflow Af1 and the rear airflow Af2 may be widely employed.

As shown in FIG. 3, the upper face of the arm 12 and the wall face 14 are connected by an inclined face 15. As the inclined face 15, for example, the following configuration may be mentioned. The inclined face 15 and the upper face of the arm 12 are smoothly connected. Further, the inclined face 15 is smoothly connected to the wall face 14. In addition, as described above, the expression "smoothly connected" indicates to be continuous while maintaining a possibility to be differentiated, in other words, to be continuous while a sharpened part is not generated. A longitudinal sectional shape of the inclined face 15 may be a curve that is concave downwardly in the axial direction.

In addition, the inclined face 15 is not limited to the above-described configuration, and as the inclined face 15, a configuration which may suppress turbulence of the airflow Afw flowing along the upper face of the arm 12 and change a direction of the airflow Afw into a direction along the wall face 14 may be widely employed. For example, a longitudinal sectional shape may be a straight-line or substantially straight-line shape, and a longitudinal sectional shape may be a shape combining straight lines whose angles are changed in turn as they approach the wall face 14.

Subsequently, the motor 20 rotating the impeller 30 is described. As shown in FIGS. 2 and 3, the motor 20 is disposed inside the impeller 30 in the axial direction. The motor 20 is provided with a shaft 21, the bearing 22, the stator 23, and a rotor 24. The motor 20 is a so-called brushless motor of outer rotor type, and the rotor 24 facing a radial outer face of the stator 23 in the radial direction is rotated around the central axis. In addition, the motor 20 is provided with the circuit board 40.

The shaft 21 is formed of a cylindrical magnetic body extending along the central axis Cx. The shaft 21 is formed of, for example, iron. The bearing 22 has a cylindrical or substantially cylindrical shape and is press-fitted into the housing 111. As a result, the bearing 22 is fixed to the housing 111. The bearing 22 rotatably supports the shaft 21. The bearing is a fluid bearing, and lubricating oil (not shown) is interposed between the inner face of the bearing 22 and the outer face of the shaft 21. The oil reduces resistance of friction between the inner face of the bearing 22 and the outer side face of the shaft 21. Accordingly, the shaft 21 is rotatably supported by the bearing 22. In other words, the shaft 21 is rotatably supported by the base 11 to which the bearing 22 is fixed. Also, at least the inner face of the bearing 22 has a structure in which oil is circulated in (supplied to) a gap between the inner face of the bearing 22 and the outer face of the shaft 21. Examples of the structure may include a porous body.

The shaft 21 is rotatably supported by the bearing 22. In addition, a part of a lower end side of the shaft 21 protrudes downwardly farther than the bearing 22. The shaft 21 includes a retaining groove 211 in the part protruding downwardly farther than the bearing 22. The retaining groove 211 is concave in the radial direction and surrounds around the outer circumference of the shaft 21.

A retaining ring 26 is attached to the retaining groove 211 of the shaft 21. That is, the retaining ring 26 has an annular or substantially annular shape, and the shaft 21 passes through the retaining ring 26. In addition, an inner diameter of a through hole of the retaining ring 26 is smaller than an outer diameter of a part vertically adjacent to the retaining groove 211 of the shaft 21. For this reason, when the shaft 21 is moved upwardly, a side wall of the retaining groove 211, which is directed in the axial direction, is brought into contact with the retaining ring 26 in the axial direction. Thus, the shaft 21 is retained in the axial direction. In addition, while the bearing 22 is a fluid dynamic pressure bearing, the bearing is not limited thereto. For example, a bearing such as a ball bearing and the like may be used as the bearing. A bearing having a configuration in which the shaft 21 can be smoothly rotated may be widely employed.

As described above, the outer face of the shaft 21 and the inner face of the bearing 22 are lubricated by oil. For this reason, the shaft 21 is easily moved not only in the circumferential direction but also in the axial direction with respect to the bearing 22. Therefore, the motor 20 is provided with a magnetic attraction 25 that attracts the shaft 21 so as to prevent rattling in the axial direction. The magnetic attraction 25 is provided with a chip holder 251 and an attraction magnet 252. The chip holder 251 has a cylindrical or substantially cylindrical shape with a bottom, and the chip holder includes a bottom part at a lower end, and a flange 253 widened outwardly in the radial direction at an upper end. The chip holder 251 is manufactured by, for example, pressing working, drawing working, or the like for a metal plate. An example of the metal plate for forming the chip holder 251 may be an iron plate.

The chip holder 251 is fixed to a bottom part of the housing 111 of the base 11. And then, the flange 253 is in contact with a lower face of the retaining ring 26. Due to this configuration, the retaining ring 26 is held and fixed by a lower end face of the bearing 22 and an upper face of the flange 253. Further, even when the chip holder 251 is to come off due to vibration, impact, or the like applied thereto, the flange 253 is to be in contact with the retaining ring 26 and thereby an upward movement of the retaining ring 26 is restricted. This makes it difficult for the shaft 21 to come off.

The attraction magnet 252 has a cylindrical or substantially cylindrical shape and is accommodated inside the chip holder 251. Here, the chip holder 251 is formed of iron, and is formed of a magnetic material. For this reason, the attraction magnet 252 is fixed to a bottom face of the chip holder 251 by a magnetic force. Further, a part of an outer circumferential face of the attraction magnet 252 is brought into contact with and fixed to an inner face of a cylinder of the chip holder 251 by the magnetic force.

In addition, a thrust plate, which is not shown in the drawings, is disposed on an upper face of the attraction magnet 252. The thrust plate is formed of a material through which magnetic flux easily penetrates, or a magnetic material. In addition, a lower face of the shaft 21 faces the thrust plate.

Due to this configuration, the lower face of the shaft 21 is attracted by the magnetic force of the attraction magnet 252, and the lower face of the shaft 21 comes into contact with the thrust plate. Also, the shaft 21 is rotated in a state in which the shaft 21 is attracted by the attraction magnet 252 and the lower face thereof is in contact with the thrust plate.

The rotor 24 is provided with a rotor magnet 241 and a magnet holder 242. The rotor magnet 241 has a cylindrical or substantially cylindrical shape, and the magnetic pole face of N pole and the magnetic pole face of S pole are alternately arranged in the circumferential direction. As the rotor magnet 241, a rotor magnet formed by alternately magnetizing N-poles and S-poles in a circumferential direction on an integrally molded cylindrical body formed of a resin in which magnetic powder is mixed may be an example. Further, the rotor magnet 241 may be composed of a plurality of magnet pieces. In this case, it is preferred that the N pole and the S pole of each magnet piece may be alternately disposed in the circumferential direction.

The magnet holder 242 is formed of a magnetic material, and the rotor magnet 241 fixed to an inner face of the magnet holder 242. The magnet holder 242 is provided with a lid 243 and a holder cylinder 244. The lid 243 has an annular or substantially annular shape. The holder cylinder 244 extends downwardly from a radial outer edge of the lid 243. In addition, the magnet holder 242 is fixed inside a hub cylinder 321 of the impeller 30. Due to this configuration, a center of the rotor magnet 241 overlaps with the central axis Cx.

Next, details of the stator 23 are described. As shown in FIGS. 2 and 3, the stator 23 is provided with a stator core 231, an insulator 232, and a coil 233. The stator core 231 is a stacked body in which electrical steel sheets are stacked in the axial direction. In addition, the stator core 231 is not limited to the stacked body in which the electric steel sheets are stacked, may be a single member obtained by, for example, firing or casting the powder, and the like.

The stator core 231 has an annular or substantially annular core back 234 and a plurality of teeth 235. An inner face of the annular core back 234 is fixed to an outer side face of the housing 111 (see FIG. 3). In addition, it is desirable that the core back 234 and the housing 111 are relatively fixed. For example, a fixing member may be interposed between the housing 111 and the core back 234.

The plurality of teeth 235 extend outwardly in the radial direction from an outer side face of the core back 234 towards the rotor magnet 241, and is to be radially formed. The coil 233 is defined by a conducting wire around each of the teeth 235 via the insulator 232.

The insulator 232 is formed of, for example, a resin or the like, and covers at least the teeth 235. Further, the insulator 232 insulates the coil 233 and the stator core 231 including the teeth 235. In addition, material for the insulator 232 is not limited to resin, and any material which may insulate the stator core 231 and the coil 233 may be widely employed.

In the motor 20, by supplying a current to the coil 233, the coil 233 is excited. An attractive force or a repulsive force is generated between the coil 233 and the rotor magnet 241. By adjusting the timing of the attractive force and the repulsive force, the rotor 24 is rotated around the central axis Cx.

The impeller 30 is a so-called centrifugal fan-type impeller that generates airflow outwardly in the radial direction by rotation thereof. When the impeller 30 is rotated, the impeller 30 takes air in from a radial-directional central part of an upper face, and the air in which the impeller 30 takes is sent out outwardly in the radial direction. The impeller 30 is, for example, a resin molded product. Examples of resin constituting the impeller 30 may include an engineering plastic. The engineering plastic is a resin having excellent mechanical properties such as strength, heat resistance, and the like. In addition, the impeller 30 may be formed of a material such as a metal.

As shown in FIGS. 1, 2, and 3, the impeller 30 has an impeller base 31, an impeller hub 32, a plurality of blades 33, and a support frame 34. As shown in FIG. 3, the impeller base 31 has an annular or substantially annular cross section when taken along a plane perpendicular to the central axis Cx, and has a slope directed outwardly in the radial direction while being directed downwardly in the axial direction.

A radial outer edge of the impeller base 31 is located downwardly farther than an upper end of the wall face 14. That is, an axial lower end of the impeller 30 is located downwardly farther than the axial upper end of the wall face 14. Due to this confirmation, it is possible to locate the axial lower end of the impeller 30 near to the arm 12 such that the air blower A may have a shorter axial length. For this reason, it is possible to miniaturize the air blower A having the same flow rate (discharge rate) in the axial direction. In other words, in the case of the air blower A having the same axial length, it is possible for the impeller 30 to have a longer axial length such that so it is possible to increase the flow rate (discharge rate) of the airflow.

In the outer side in the radial direction farther than the impeller hub 32 disposed on an inner circumferential part of the impeller base 31, the plurality of the blades 33 (eleven blades in this case, as shown in FIG. 1) are disposed at equal interval in the circumferential direction. As compared to a radial outer side of the blade 33, a radial inner side of the blade 33 is located at the front side in the rotational direction of the impeller 30. Due to this configuration, when the impeller 30 is rotated in the rotational direction Rt, an airflow directed outwardly in the radial direction is generated. The support frame 34 has an annular or substantially annular shape and is connected to the radial outer edge of the upper end of the plurality of blades 33. The support frame 34 is a reinforcing member fixed to the plurality of blades 33 and reinforcing the blades 33.

As shown in FIG. 3, the impeller hub 32 is disposed on an inner circumferential part of the impeller base 31. An upper end of the shaft 21 of the motor 20 is fixed to the impeller hub 32. The impeller 30 is rotated around the central axis Cx together with the shaft 21. In addition, examples of a method for fixing the shaft 21 and the impeller 30 may include methods such as insert molding, press fitting, adhesion, welding, and the like. Further, the upper end of the shaft 21 may be screw-fixed with a screw penetrating in the axial direction from an upper face of the impeller hub 32. As a method of fixing the impeller 30 and the shaft 21, a method of firmly fixing the impeller 30 and the shaft 21 may be widely employed.

The impeller hub 32 is provided with the hub cylinder 321. The hub cylinder 321 has a cylindrical or substantially cylindrical shape extending downwardly from a lower face of a hub top plate. A center of the hub cylinder 321 overlaps with the central axis Cx. The magnet holder 242 is fixed to an inner face of the hub cylinder 321. The magnet holder 242 holds the rotor magnet 241. In addition, as the magnet holder 242 is fixed to the hub cylinder 321, the center of the rotor magnet 241 overlaps with the central axis Cx. In this example embodiment of the present disclosure, the magnet holder 242 and the hub cylinder 321 are fixed with each other by insert molding. In addition, fixing of the magnet holder 242 and the hub cylinder 321 is not limited to insert molding, and a fixing method capable of firmly fixing the magnet holder 242 and the hub cylinder 321 may be widely employed.

The air blower A has the configuration described above.

Subsequently, an airflow generated by driving the air blower A is described with reference to the drawings. FIG.

5 is an enlarged plan view in which the impeller 30 and the wall face 14 of the air blower A are enlarged. FIG. 6 is an enlarged cross-sectional view in which cross sections of the impeller 30 and the wall face 14 of the air blower A are enlarged. In FIGS. 5 and 6, the flow of air (airflow) is indicated by a broken line, and an arrow indicating flow direction is illustrated.

The air blower A is a fan of centrifugal type. For that reason, as the impeller 30 is rotated in synchronization with rotation of the motor 20, the airflow Afw having a velocity component directed outwardly in the radial direction and a velocity component directed in the rotational direction Rt of the impeller 30 is blown out from the radial outer edge of the impeller 30. Further, by rotation of the impeller 30, the impeller 30 takes air in from a central part of an axial upper end and is discharged in the radial direction. In the impeller 30, for that reason, the airflow flows along an upper face of the impeller base 31. The upper face of the impeller base 31 extends downwardly in the axial direction from the radial-directional center towards the outside. The airflow Afw blown out from the impeller 30 also includes a velocity component directed downwardly in the axial direction.

First, flow of the airflow Afw on the upper face of the arm 12 is described. As shown in FIGS. 5 and 6, the airflow Afw blown out from a radial outer side of the impeller 30 flows along the upper face of the arm 12, and then reaches the wall face 14. As described above, when viewed in a plane view, the airflow Afw has the velocity component directed outwardly in the radial direction and the velocity component directed in the rotational direction Rt of the impeller 30. In addition, the airflow Afw reaches the wall face 14 at the front side of the rotational direction Rt of the first face 141.

The airflow Afw reaching the wall face 14 is branched into the front airflow Af1 flowing along the first face 141 and the rear airflow Af2 flowing along the second face 142. The front airflow Af1 flows along the first face 141. And, the first face 141 extends outwardly in the radial direction while being directed towards the front of the rotational direction Rt.

The front airflow Af1 branched from the airflow Afw flows along the first face 141, and generation of a vortex caused by turbulence such as separation or the like is suppressed. For this reason, noise due to the generation of the vortex is suppressed. Further, it is possible to efficiently make the front airflow Af1 flow outwardly in the radial direction. For example, when the air blower A is used for cooling, cooling efficiency may be enhanced.

Figure 5:
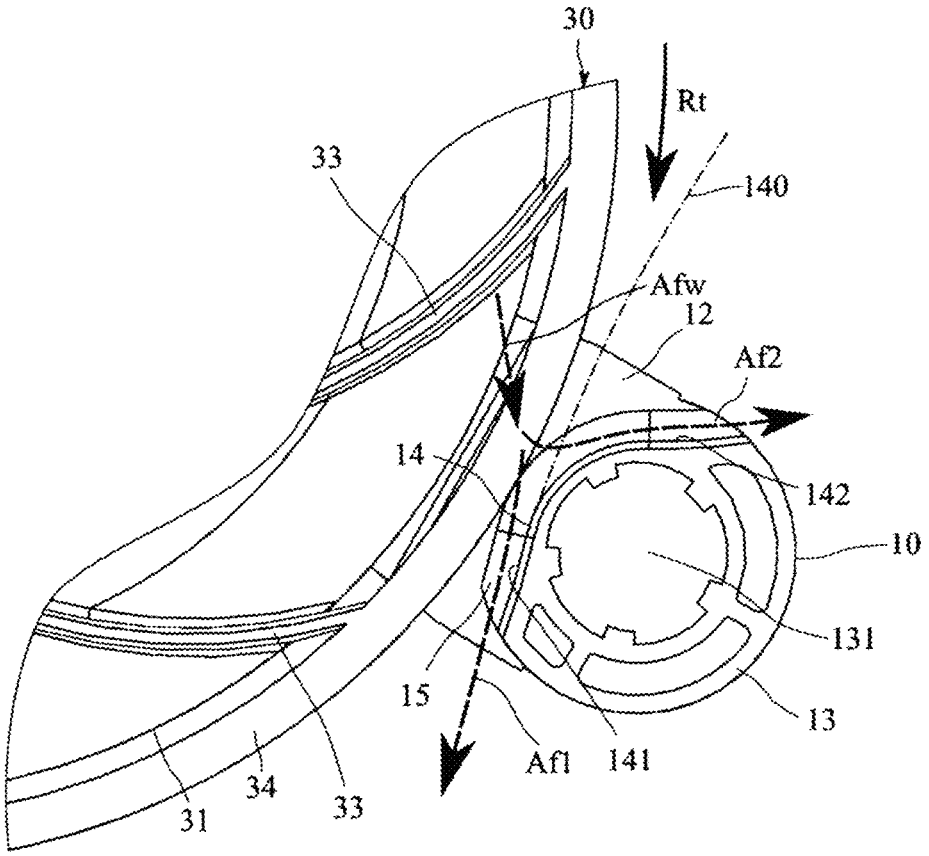
FIG. 5 is an enlarged plan view in which an impeller and a wall face of the air blower are enlarged.
Figure 6:
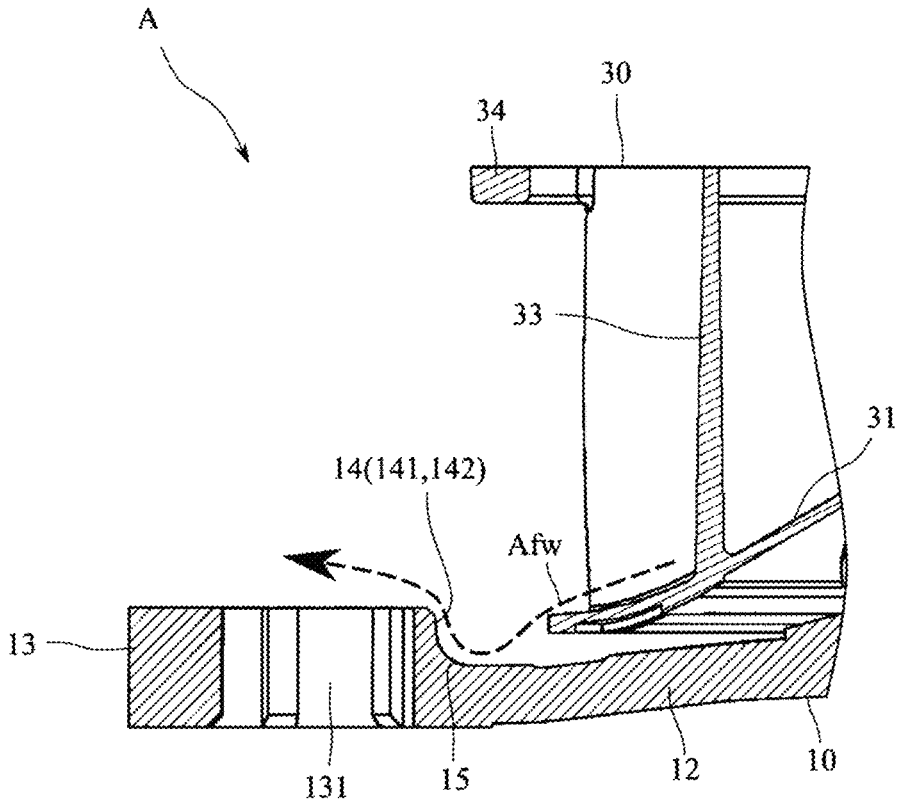
FIG. 6 is an enlarged sectional view enlarging the impeller and the wall face of the air blower.

Furthermore, as shown in FIG. 5, the face 140 extending in the circumferential direction an end of a rear side of the rotational direction Rt of the impeller 30 on the first face 141 in the rotational direction Rt of the impeller 30 is located at a radial outer side of the impeller 30. For that reason, collision of the airflow Afw blown out from the impeller 30 can be suppressed, and it is possible to smoothly guide the front airflow Af1 to the first face 141. As a result, generation of a vortex caused by turbulence such as separation or the like of the front airflow Af1 flowing along the first face 141 is suppressed such that noise is suppressed.

The second face 142 extends outwardly in the radial direction while being directed towards the rear of the rotational direction Rt. For that reason, the rear airflow Af2 flows along the second face 142 such that it is difficult for separation of the rear airflow Af2 to occur. For this reason, generation of a vortex due to separation of the rear airflow Af2 is suppressed, and noise caused by the generation of the vortex is suppressed. In addition, it is possible to efficiently flow the rear airflow Af2 outwardly in the radial direction. For example, when the air blower A is used for cooling, cooling efficiency may be enhanced.

In addition, since the first face 141 and the second face 142 are smoothly continuous, it is possible to make airflow being prone to be stagnated at a boundary between the first face 141 and the second face 142 to efficiently flow outwardly in the radial direction. This makes it possible to more efficiently suppress waste of the airflow Afw. In addition, generation of a vortex in a part where the airflow is prone to be stagnated may be suppressed. As a result, noise can be suppressed more efficiently. In addition, vibration generated by the airflow maybe suppressed as well.

Also, when it becomes possible to make all of the airflow Afw blown out from the impeller 30 flow along the first face 141, the second face 142 may be omitted. In addition, all of the airflow Afw includes not only the exact total amount but also the amount that is substantially considered to be substantially the total amount, although it is smaller than the exact total amount.

In addition, the airflow Afw flows downwardly in the axial direction and along the upper face of the arm 12. Then, the airflow Afw flows outwardly in the radial direction. As shown in FIG. 6, the upper face of the arm 12 and the wall face 14 are connected by the inclined face 15. The inclined face 15 is smoothly continuous with the upper face of the arm 12 and is also smoothly continuous with the wall face 14. For this reason, as the airflow Afw flows along the inclined face 15, a flow direction of the airflow Afw flowing along the arm 12 is gradually changed into a direction along the wall face 14. For example, when the inclined face 15 is not provided, the airflow Afw comes to be strongly in contact with the wall face 14, so a vortex is likely to be generated. By providing the inclined face 15, a flow direction of the airflow Afw may be smoothly changed at the inclined face 15 such that it is possible to suppress generation of a vortex. Noise caused by generation of a vortex may be suppressed. In addition, vibration generated by the airflow may be suppressed as well in the same manner.

Figure 7:
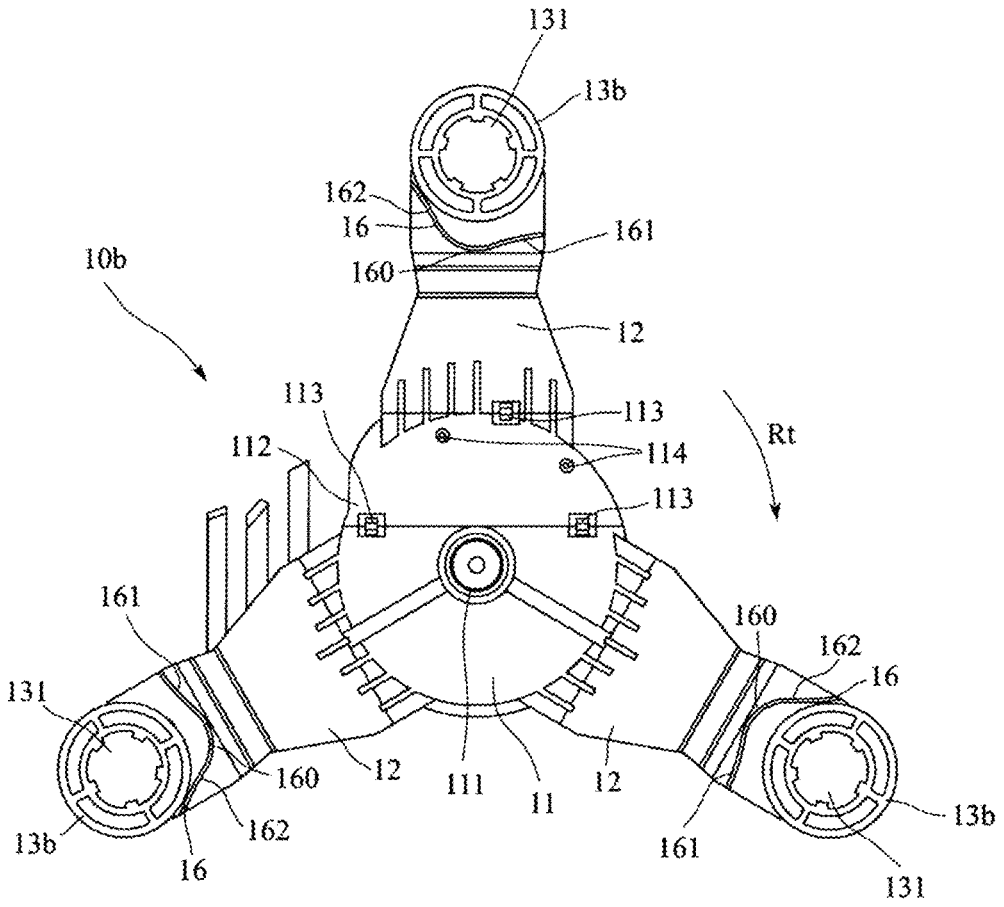
FIG. 7 is a plan view of a holder of a modified example of the present example embodiment.

A modified example of the air blower according to this example embodiment of the present disclosure is described with reference to the drawings. FIG. 7 is a plan view of a holder 10*b* according to a modified example of this example embodiment. As shown in FIG. 7, the holder 10*b* is the same as the holder 10 (see FIG. 4 and the like) except that the holder 10*b* includes a rib 16 provided with a wall face 160 and an attachment 13*b* has a cylindrical or substantially cylindrical shape. For that reason, in the holder 10*b*, parts which are identical with those of the holder 10 are denoted by the same reference numerals, and detailed description of the same parts is omitted.

As shown in FIG. 7, the holder 10*b* is provided with the rib 16 protruding upwardly in the axial direction from an upper face of an arm 12*b*. The rib 16 is provided with the wall face 160 abutting the radial inner side. That is, the arm 12*b* further includes the rib 16 extending upwardly in the axial direction between the base 11 and the attachment 13*b*. At least a part of the wall face 160 is provided on the rib 16. The wall face 160 is provided with a first face 161 and a second face 162.

The first face 161 extends outwardly in the radial direction while being directed towards the front of the rotational direction Rt of the impeller 30. The second face 162 is connected to the rear side of the rotational direction Rt on the first face 161. The second face 162 extends outwardly in the radial direction while being directed towards the rear of the rotational direction Rt. A configuration of the first face 161 and the second face 162 is the same as that of the first face 141 and the second face 142 of the holder 10.

That is, each of the first faces 161 is disposed in the rotationally symmetric manner (in this example embodiment of the present disclosure, three-times symmetry), and each of the second faces 162 is disposed in the rotationally symmetric manner (in this example embodiment, three-times symmetry). Further, the first face 161 and the second face 162 have a curved face or substantially curved face shape. For this reason, it is difficult to release the front airflow Af1 flowing along the first face 161, and it is difficult to release the rear airflow Af2 flowing along the second face 162.

In addition, if the front airflow Af1 has the configuration which makes it difficult to separate the front flow Af1, the first face 161 may have a planar or substantially planar shape. Also, if the rear airflow Af2 has the configuration making it difficult to separate the rear flow Af2, the second face 162 may have a planar or substantially planar shape.

In the holder 10*b*, since the wall face 160 is provided on the rib 16 provided separately from the attachment 13*b*, it is possible to increase the degree of freedom of the shape of the wall face 160.

In addition, since the holder 10*b* includes the first face 161 and the second face 162, turbulence of the airflow can be suppressed so as to suppress noise. Further, since it is possible to make the airflow flow smoothly, for example, when the air blower A is used for cooling, the cooling efficiency may be increased. Further, by providing the rib 16 extending upwardly from the upper face of the arm 12*b*, it is possible to increase strength of the arm 12*b*. As a result, attaching strength of the holder 10*b* may be increased, and even when vibration is transmitted to the arm 12*b*, resonance may be suppressed such that it is possible to suppress amplification of the vibration. Further, by providing the wall face 160 on the rib 16, the degree of freedom of the shape of the attachment 13*b* may be increased. As a result, strength of the attachment 13*b* may be increased, attaching strength of the air blower A may be increased, and generation of the noise can be suppressed more efficiently. In addition, similarly, vibration generated by the airflow may also be suppressed.

As described above, the holder 10 is provided with the wall face 14 to suppress turbulence of the airflow Afw generated by the impeller 30 and thereby to suppress noise. On the other hand, the airflow Afw flows separately along the first face 141 and the second face 142 of the wall face 14. For that reason, the airflow may be slightly turbulent at a place where the airflow collides with the wall face 14, at a place where the airflow is separated, and at a rear edge of the airflow direction in the wall face 14 such that noise may be generated.

In addition, when three arms 12, that is, the wall face provided on each of the attachment 13, respectively, is rotationally symmetric with each other, there is a possibility that the airflow turbulence in the same degree may occur on all the wall faces 14 at the same time. In this case, there is a concern that resonance generated by noise generated in each of the wall faces 14 may lead to loud noise. In addition, similarly, there is a concern that vibration generated by the airflow may also become a huge vibration by resonance.

Figure 8:
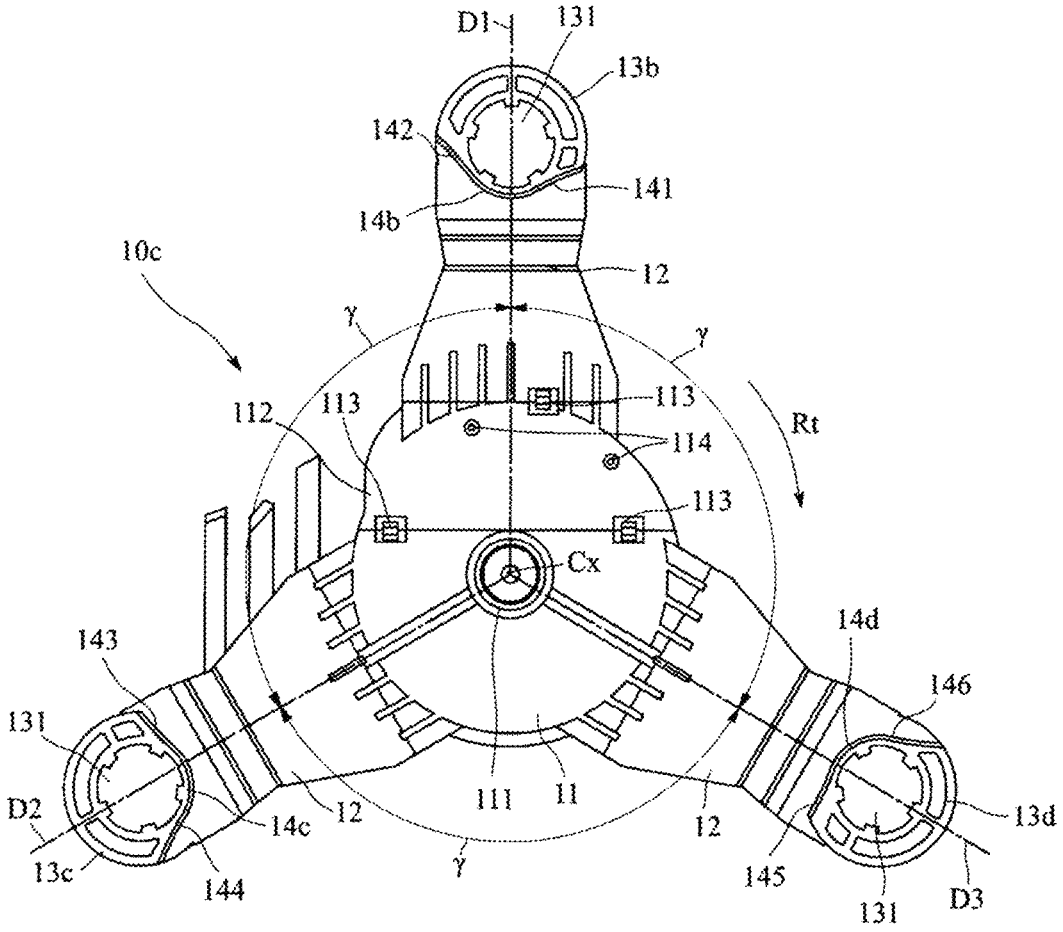
FIG. 8 is a plan view of the holder of a modified example of the present example embodiment.
Figure 9:
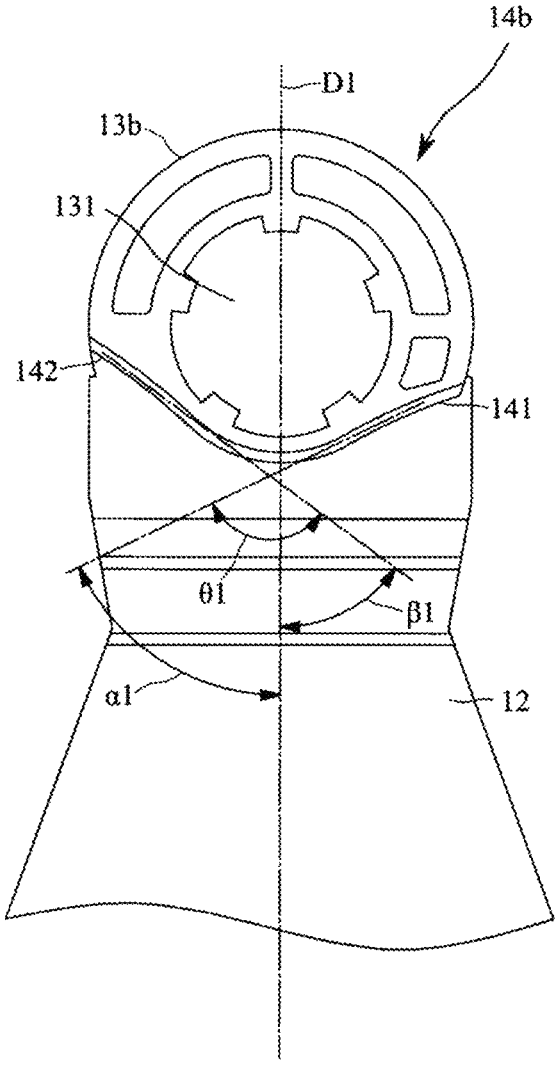
FIG. 9 is a view showing a first wall face of the holder shown in FIG. 8 side by side.
Figure 10:
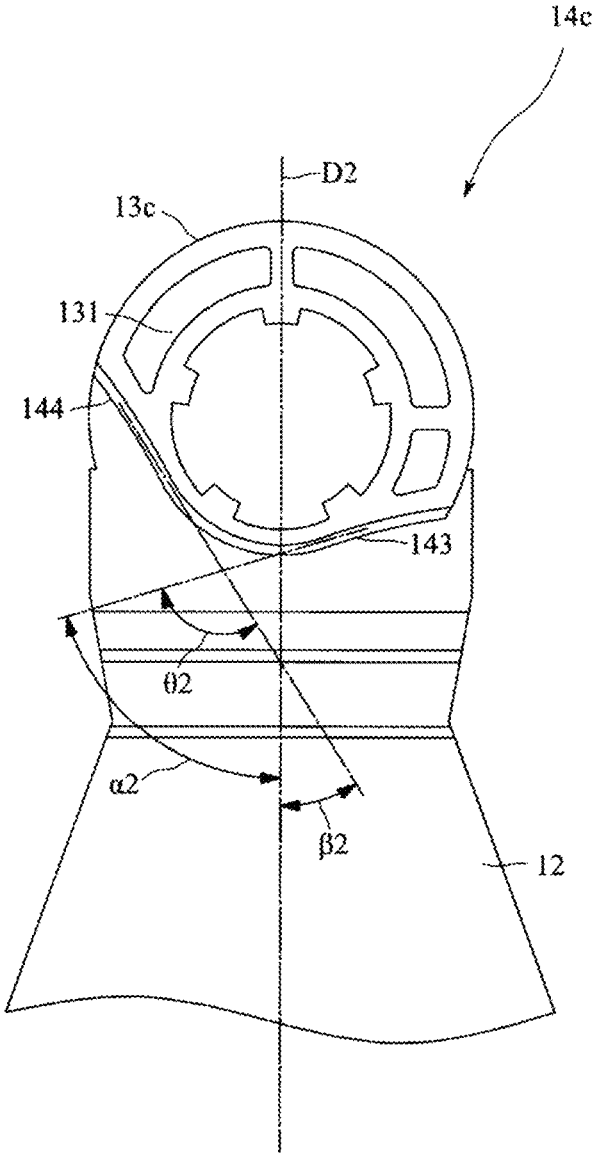
FIG. 10 is a view showing a second wall face of the holder shown in FIG. 8 side by side.
Figure 11:
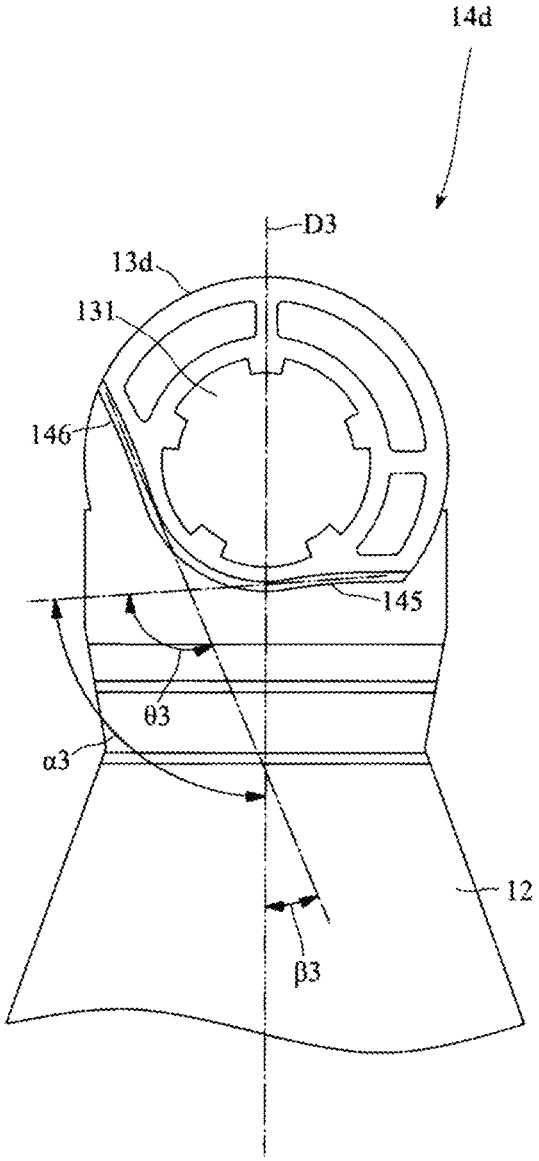
FIG. 11 is a view showing a third wall face of the holder shown in FIG. 8 side by side.

Therefore, in the holder 10*c* of this modified example of the example embodiment, resonance is suppressed by changing the shape of the wall face. Hereinafter, a specific configuration for suppressing resonance is described with reference to the drawings. FIG. 8 is a plan view of a holder 10*c* according to a modified example of this example embodiment of the present disclosure. FIG. 9 is a view of a first wall face 14*b* of the holder 10*c* shown in FIG. 8. FIG. 10 is a view of a second wall face 14*c* of the holder 10*c* shown in FIG. 8. FIG. 11 is a view of a third wall face 14*d* of the holder 10*c* shown in FIG. 8.

As shown in FIGS. 8 and 9, each of the first wall faces 14*b*, the second wall face 14*c*, and the third wall face 14*d* having different shapes with each other is provided on each of the arms 12 in the holder 10*c*. That is, the first wall faces 14*b*, the second wall face 14*c*, and the third wall face 14*d* are formed in the rotationally asymmetric manner. The configuration of the holder 10*c* is the same as that of the holder 10 except the above wall face. For that reason, in the holder 10*c*, parts identical with those of the holder 10 are denoted by the same reference numerals in the holder 10*c*, and detailed description of the same parts is omitted.

In addition, in FIG. 8, all of the center lines D1, D2, and D3 pass through a circumferential-directional center of each of the arms 12 and are a straight line perpendicular to the central axis Cx.

Resonance of noise caused by the airflow Afw may be suppressed by shifting at least one of a frequency and a phase. For this reason, as shown in FIG. 8, when viewed in a plan view, inclination angles of the first wall face 14*b*, the second wall face 14*c*, and the third wall face 14*d* with respect to the center lines D1, D2, and D3, respectively differ with each other in the holder 10*c*.

As shown in FIG. 8, the first wall face 14*b* has the configuration identical with that of the wall face 14 of the holder 10 shown in FIG. 4 described above, and the first face 141 and the second face 142 are formed on an outer side face of the attachment 13*b*. When viewed in a plan view as shown in FIG. 9, the first face 141 is inclined at an inclination angle $\alpha 1$ with respect to the center line D1, and the second face 142 is inclined at an inclination angle $\beta 1$ with respect to the center line D1. In addition, when viewed in a plan view, the first face 141 is disposed with respect to the second face 142 an angle $\theta 1$. In addition, since the first face 141 and the second face 142 are curved faces, the above-mentioned angles are strictly not exact angles, and indicate approximate inclination angles of the first face 141 and the second face 142 with respect to the center line D1.

In addition, a first face 143 and a second face 144 are provided on an outer side face of an attachment 13*c* in the second wall face 14*c*. When viewed in a plan view as shown in FIG. 10, the first face 143 is inclined at an inclination angle $\alpha 2$ with respect to the center line D2, and the second face 144 is inclined at an inclination angle 132 with respect to the center line D2. In addition, when viewed in a plan view, the first face 143 is disposed with respect to the second face 144 an angle $\theta 2$. Furthermore, similar to in the first wall face 14*b*, an angle of each face of the second wall face 14*c* indicates an approximate inclination angle of each face with respect to the center line D2.

Further, a first face 145 and a second face 146 are provided on an outer side faces of an attachment 13*d* in the third wall face 14*d*. When viewed in a plan view as shown in FIG. 11, the first face 145 is inclined at an inclination angle $\alpha 3$ with respect to the center line D3, and the second face 146 is inclined at an inclination angle 133 with respect to the center line D3. In addition, when viewed in a plan view, the first face 145 is disposed with respect to the second face 146 an angle $\theta 3$. Furthermore, similar to the first wall face 14*b*, an angle of each face of the third wall face 14*d* indicates an estimated inclination angle of each face with respect to the center line D3.

When viewed in a plan view, the first faces 141, 143, and 145 of the first wall face 14*b*, the second wall face 14*c*, and the third wall face 14*d* are inclined at the inclination angles $\alpha 1$, $\alpha 2$, and $\alpha 3$ with respect to the center lines D1, D2, and D3, respectively. In addition, the relation of the inclination angles is $\alpha 1 \approx \alpha 2 \neq \alpha 3$. In other words, when viewed in a plan view, the inclination angles $\alpha 1$, $\alpha 2$, $\alpha 3$ of the first faces 141, 143, and 145 with respect to the center lines D1, D2, and D3 that pass the circumferential-directional center of the arms 12 and are perpendicular to the central axis Cx differ from each other on at least two wall faces. That is, when one arm of two arms among the arms 12 is moved to the other arm of two arms among the arms 12 by rotation around the central axis Cx by the central angle $\gamma$ between the two arms among the arms 12, the shapes of the first faces 141, 143, 145 do not coincide with the shapes of the first faces of the other arm. That is, the first faces 141, 143 and 145 are disposed in the rotationally asymmetrical manner.

As described above, when viewed in a plan view, the inclination angles of the first faces 141, 143, and 145 with respect to the center lines D1, D2, and D3, which are straight lines connecting the circumferential-directional center of the arms 12 and the central axis Cx, differ from each other such that relative shapes of the first faces 141, 143, and 145 with respect to the impeller 30 are different from each other.

For this reason, lengths of streamlines of the front airflows Aft flowing along the first faces 141, 143, and 145 of the first wall face 14*b*, the second wall face 14*c*, and the third wall face 14*d* are changed. For example, when approximately identical airflow Afw is blown to the first wall face 14*b*, the second wall face 14*c*, and the third wall face 14*d*, the flow rate of the front airflow Af1 flowing along each of the first faces 141, 143, and 145 differs from each other. As a result, frequencies of the noise generated on the first wall face 14*b*, the second wall face 14*c*, and the third wall face 14*d* by the front airflow Af1 are shifted. For this reason, resonance is suppressed such that noise is reduced. In addition, not the frequency but the phase may be shifted. And even in this case, resonance is suppressed such that noise is reduced. Further, it is possible to further enhance the effect of suppressing noise by shifting both the frequency and the phase. In addition, vibration generated by the airflow when an air blower A is being driven is also suppressed.

Also, when viewed in a plan view, the second faces 142, 144, and 146 of the first wall face 14*b*, the second wall face 14*c*, and the third wall face 14*d* are inclined at the inclination angles 31, 32, and 33 with respect to the center lines D1, D2, and D3, respectively. In addition, the relation of the inclination angles is $\beta 1 \neq \beta 2 \neq \beta 3$. In other words, the inclination angles $\beta 1$, $\beta 2$, and $\beta 3$ of the second faces 142, 144, and 146 with respect to the center lines D1, D2, and D3 connecting the circumferential-directional center of the arms 12 and the central axis Cx differ from each other on at least two wall faces. That is, at least two or more of the first wall faces 14*b*, the second wall face 14*c*, and the third wall face 14*d* have the second faces 142, 144, and 146. In addition, when one arm of two arms among the arms 12 is moved to the other arm of two arms among the arms 12 by rotation around the central axis Cx by the central angle $\gamma$ between the two arms among the arms 12, the shapes of the second faces 142, 144, 146 of the one arm do not coincide with the shapes of the second faces 142, 144, 146 of the other arm. That is, the second faces 142, 144, and 146 are disposed in the rotationally asymmetrical manner.

As described above, the inclination angles of the second faces 142, 144, and 146 with respect to the center lines D1, D2, and D3 which are straight lines connecting the circumferential-directional centers of the arms 12 and the central axis Cx, differ from each other such that relative shapes of the second faces 142, 144, and 146 with respect to the impeller 30 are different from each other.

For this reason, lengths of the streamlines of the rear airflows Af2 flowing along the second faces 142, 144, and 146 of the first wall face 14*b*, the second wall face 14*c*, and the third wall face 14*d* are changed. For example, when approximately identical airflow Afw is sprayed to the first wall face 14*b*, the second wall face 14*c*, and the third wall face 14*d*, flow rates of the rear airflow Af2 flowing along the second faces 142, 144, and 146 are changed. For that reason, the frequencies of noise generated on the first wall face 14*b*, the second wall face 14*c*, and the third wall face 14*d* by the rear airflow Af2 are shifted. For this reason, resonance is suppressed such that noise is reduced. In addition, there is a case in which not the frequency but the phase may be shifted. And even in this case, resonance is suppressed such that noise is reduced. Further, it is possible to further enhance the effect of suppressing noise by shifting both the frequency and the phase. In addition, vibration generated by the airflow when the air blower C is being driven is also suppressed.

Further, when viewed in a plan view, angles of the first faces 141, 143, 145 of the first wall face 14*a*, the second wall face 14*b*, the third wall face 14*c* with respect to the second faces 142, 144, 146 of the first wall face 14*a*, the second wall face 14*b*, the third wall face 14*c* are angles $\theta 1$, $\theta 2$, $\theta 3$, respectively. The relation of the above angles is $\theta 1 \neq \theta 2 \neq \theta 3$, and the angles formed between the first faces 141, 143, 145 and the second faces 142, 144, 146 differ from those of the other first face. Therefore, positions of the boundaries of the first faces 141, 143, 145 and the second faces 142, 144, 146 with respect to the center lines D1, D2, D3 are also different from each other. For this reason, the branching points and the branching timings at which the airflow Afw blown out from the impeller 30 is branched into the front airflow Af1 and the rear airflow Af2 also differ from each other on the first wall face 14*b*, the second wall face 14*c*, and the third wall face 14*d*.

The frequencies of noise generated when the airflow Afw collides with the first wall face 14*b*, the second wall face 14*c*, and the third wall face 14*d* are shifted. For this reason, resonance is suppressed such that noise is reduced. In some cases, not the frequency but the phase may be shifted. And even in this case, resonance is suppressed such that noise is reduced. Further, it is possible to further enhance the effect of suppressing noise by shifting both the frequency and the phase. In addition, vibration generated by the airflow when the air blower C is being driven is also suppressed.

As described above, noise may be suppressed by providing the first wall face 14*b*, the second wall face 14*c*, and the third wall face 14*d* in the rotationally asymmetric manner. In addition, vibration that occurs is also suppressed as similar to noise.

In addition, although in this modified example, the first faces 141, 143, and 145 are disposed in the rotationally asymmetric manner, and the second faces 142, 144, and 146 are disposed in the rotationally asymmetrical manner, the present disclosure is not limited to these dispositions. Only one face of the first faces or only one face of the second faces may be disposed in the rotationally asymmetrical manner.

Furthermore, although all the wall faces 14*b*, 14*c*, and 14*d* have shapes which differ with each other in this modified example, the present disclosure is not limited to this configuration. Some wall faces among the plurality of wall faces may have the same shape, and the remaining wall face may have a different shape.

Further, each of the inclination angles of the first wall face 14*b*, the second wall face 14*c*, and the third wall face 14*d* with respect to the upper face of the arm 12 may differ from that of the other wall face.

Figure 12:
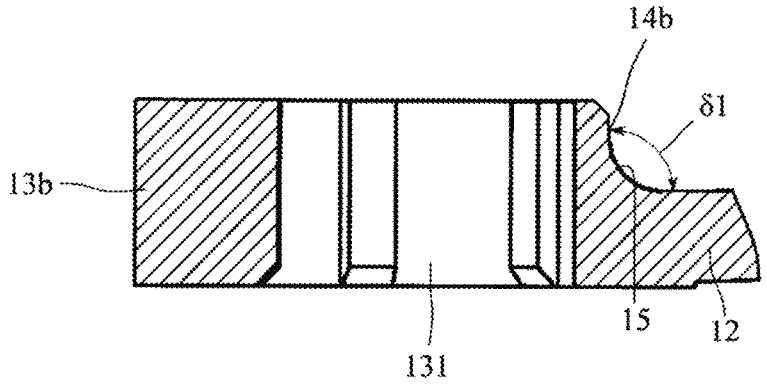
FIG. 12 is a cross-sectional view taken along a plane including a central axis and a central line of the first wall face of the holder shown in FIG. 8.
Figure 13:
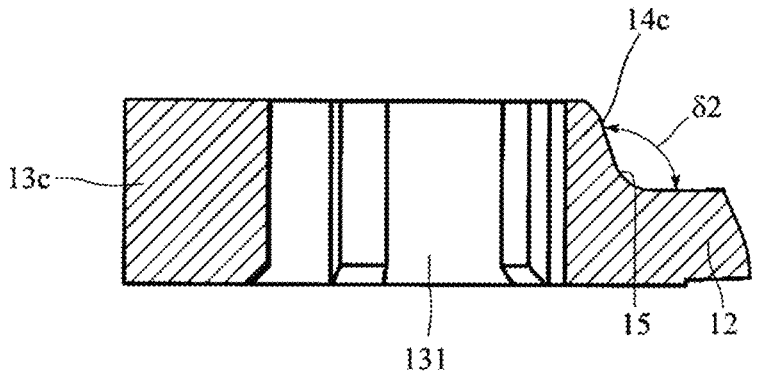
FIG. 13 is a cross-sectional view taken along a plane including a central axis and a central line of the second wall face of the holder shown in FIG. 8.
Figure 14:
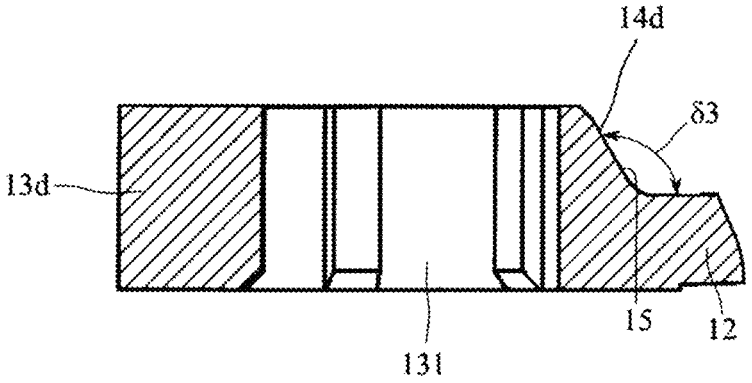
FIG. 14 is a cross-sectional view taken along a plane including a central axis and a central line of the third wall face of the holder shown in FIG. 8.

FIG. 12 is a cross-sectional view taken along a plane including the central axis and the center line of the first wall face 14*b* of the holder 10*c* shown in FIG. 8. FIG. 13 is a cross-sectional view taken along a plane including the central axis and the center line of the second wall face 14*c* of the holder 10*c* shown in FIG. 8. FIG. 14 is a cross-sectional view taken along a plane including the central axis and the central line of the third wall face 14*d* of the holder 10*c* shown in FIG. 8.

As shown in FIG. 12, the first wall face 14*b* of the attachment 13*b*, and the upper face of the arm 12 form an angle δ1. As shown in FIG. 13, the second wall face 14*c* of the attachment 13*c*, and the upper face of the arm 12 form an angle δ2. Further, as shown in FIG. 14, the third wall face 14*d* of the attachment 13*d*, and the upper face of the arm 12 form an angle δ3. In addition, the relation of the above angles is δ1≠β2≠β3, and the angle formed by any one of the first wall face 14*b*, the second wall face 14*c* and the third wall face 14*d*, and the upper face of the arm 12 differs from that formed by another wall face and the upper face of the arm.

As shown in FIG. 6, the airflow flowing on the upper face of the arm 12 also flows on the upper sides of the attachments 13*b*, 13*c*, and 13*d*. Due to the relation of δ116 δ2≠δ3, each of the streamlines of the airflows which flow from the upper face of each arm 12 and then pass through the first wall face 14*b*, the second wall face 14*c*, and the third wall face 14*d*, and then flow to the upper sides of the attachments 13*b*, 13*c*, and 13*d* also differs with each other. Therefore, the flow rate of each of the airflows differs with each other. Accordingly, the frequencies of noise generated on the first wall face 14*b*, the second wall face 14*c*, and the third wall face 14*d* by the airflow flowing on the upper sides the attachments 13*b*, 13*c*, 13*d* are shifted. For this reason, resonance is suppressed such that noise is reduced. Also, there is a case in which not the frequency but the phase may be shifted. And even in this case, resonance is suppressed such that noise is reduced. Further, it is possible to further enhance the effect of suppressing noise by shifting both the frequency and the phase. In addition, vibration generated by the airflow when the air blower C is being driven is also suppressed.

Further, similar to the wall face of the second modified example, the wall face includes the first face and the second face. In addition, the angles of the first face and the second face included in the same wall face with respect to the upper face of the arm are the same. However, the angles of the first face and the second face with respect to the upper face of the arm may differ with each other. The angle of the first face of each wall face with respect to the upper face of the arm may differ from the angle of the first face of the other wall face with respect to the upper face of the arm. Further, the angle of the second face of each wall face with respect to the upper face of the arm may differ from the angle of the second face of the other wall face with respect to the upper face of the arm. Furthermore, the difference between the angle between the first face included in the wall face and the upper face of the arm, and the angle between the second face and the upper face of the arm or the ratio of both angles may differ with each other in each wall face. Even in these cases, there is an effect that resonance is suppressed so as to reduce vibration.

In addition, although the shapes of all the wall faces 14*b*, 14*c*, and 14*d* are different with each other in this modified example, but the present disclosure is not limited to this configuration. In the plurality of wall faces, some of the wall faces may have the same shape, and the remaining wall face may have different shapes.

According to the present disclosure, the air blower may be employed as a cooling fan which circulates cold air provided in a refrigerator, for example.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. An air blower, comprising:

an impeller rotatable about a central axis extending vertically;

a motor to rotate the impeller; and a holder to hold the motor; wherein the air blower is a centrifugal air blower which generates a radial airflow perpendicular to the central axis;

the holder includes:

a base on which the motor is provided;

a plurality of attachments on a radial directional-outer side of the impeller;

a plurality of arms connecting the base and each of the attachments; and a wall surface located at a side where the impeller is provided, between the base and each attachment, and opposing a radial-directional inner side;

an axial lower end of the impeller is located below an axial upper end of the wall surface; and an axial upper end of the impeller is located axially above axially upper ends of the plurality of attachments.

2. The air blower of claim 1, wherein an axial upper surface of one of the arms and the wall surface are connected with each other by an inclined surface inclined with respect to the central axis.

3. The air blower of claim 2, wherein the inclined surface has a longitudinal sectional shape which is concave towards a lower side in an axial direction.

4. The air blower of claim 1, wherein an inclination angle of the wall surface with respect to an axial surface of one of the arms differs from that of another wall surface.

5. The air blower of claim 1, wherein at least a portion of the wall surface is provided on an outer surface of the attachment.

6. The air blower of claim 1, wherein at least one of the arms includes a rib extending upwardly in an axial direction between the base and one of the attachments, and at least a portion of the wall surface is provided on the rib.

7. The air blower of claim 1, wherein the plurality of arms include three arms spaced apart from one another at equal intervals in the circumferential direction.

8. The air blower of claim 1, wherein a radially outer edge of one of the plurality of arms is located farther downward than the base.

9. The air blower of claim 1, wherein the impeller includes an impeller base, an impeller hub, and a plurality of blades; and the impeller base has an annular or substantially annular cross section when taken along a plane perpendicular to the central axis, and has a slope directed outwardly in a radial direction while being directed downwardly in an axial direction.

10. The air blower of claim 1, wherein a first wall surface of one of the plurality of the attachments and an upper surface of one of the plurality of the arms define an angle δ1, a second wall surface of one of the plurality of the attachments and the upper surface of one of the plurality of the arms define an angle δ2, and a third wall surface of one of the plurality of the attachments and the upper surface of one of the plurality of the arms define an angle δ3; and a relation of the above angles is $\delta 1 \neq \delta 2 \neq \delta 3$.

* * * * *